United States Patent [19]

Stolzman

[11] Patent Number: 4,813,592

[45] Date of Patent: Mar. 21, 1989

[54] SEALING CLOSURE FOR LINED DRUMS

[75] Inventor: Michael D. Stolzman, Lake Forest, Ill.

[73] Assignee: International Precision Components Corporation, Lake Forest, Ill.

[21] Appl. No.: 199,148

[22] Filed: May 26, 1988

[51] Int. Cl.[4] ..... B65D 3/30

[52] U.S. Cl. ..... 229/5.7; 220/67; 220/73

[58] Field of Search ..... 220/67, 73; 229/5.7, 229/5.6

[56] References Cited

U.S. PATENT DOCUMENTS 4,457,465 7/1984 Shepard et al. ..... 229/5.6

4,483,456 11/1984 Mays ..... 220/67

4,720,038 1/1988 Shepard ..... 229/5.7

*Primary Examiner*—George T. Hall

*Attorney, Agent, or Firm*—Wood, Dalton, Phillips, Mason & Rowe

[57] ABSTRACT

A sealing closure for lined liquid-permeable drums permitting the drums to be used for storing and shipping liquids. The drum may be formed of conventional fiberboard having a liquid-impermeable liner on the inner surface thereof. The closure is formed of a liquid-impermeable synthetic resin having a peripheral portion sealingly clamped to the liner by a clamp ring. The clamp ring is formed from a cylindrical metal ring into a turned configuration providing improved sealing clamping between the peripheral portion of the closure and the liner on the drum.

19 Claims, 3 Drawing Sheets

FIG. 1
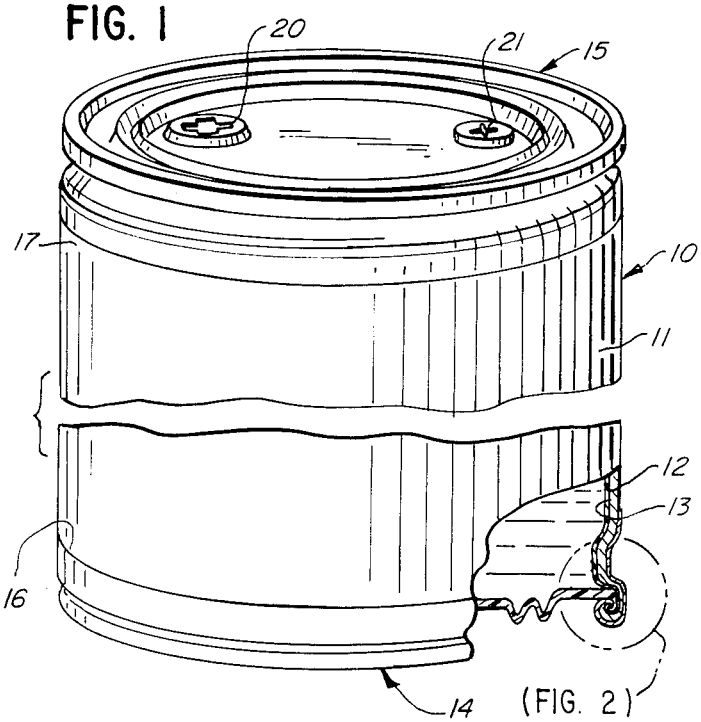
FIG. 2
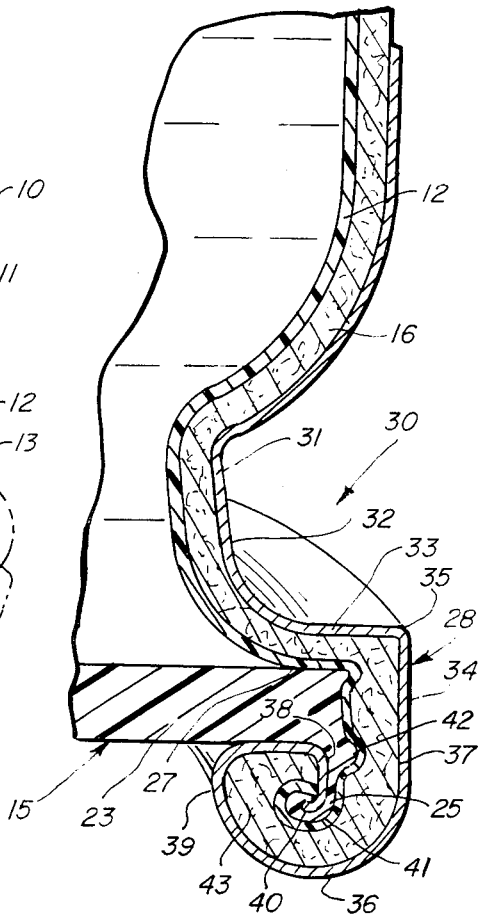
FIG. 3
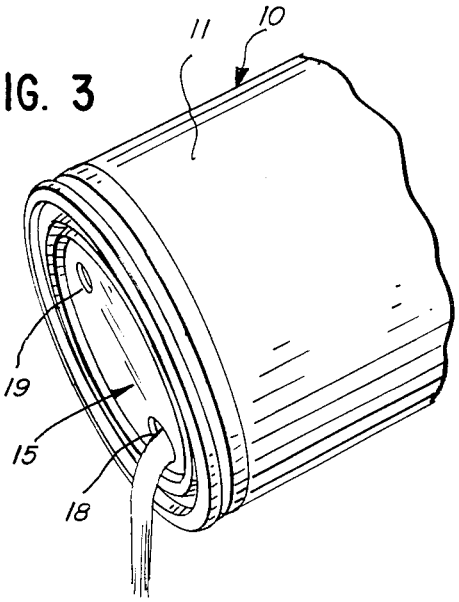
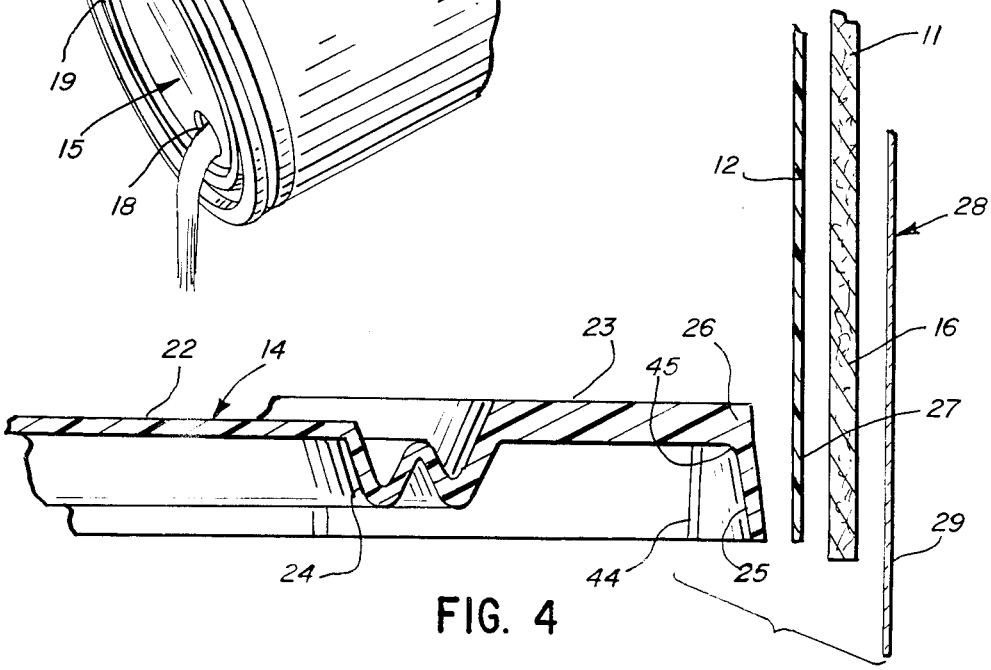
FIG. 4

FIG. 5
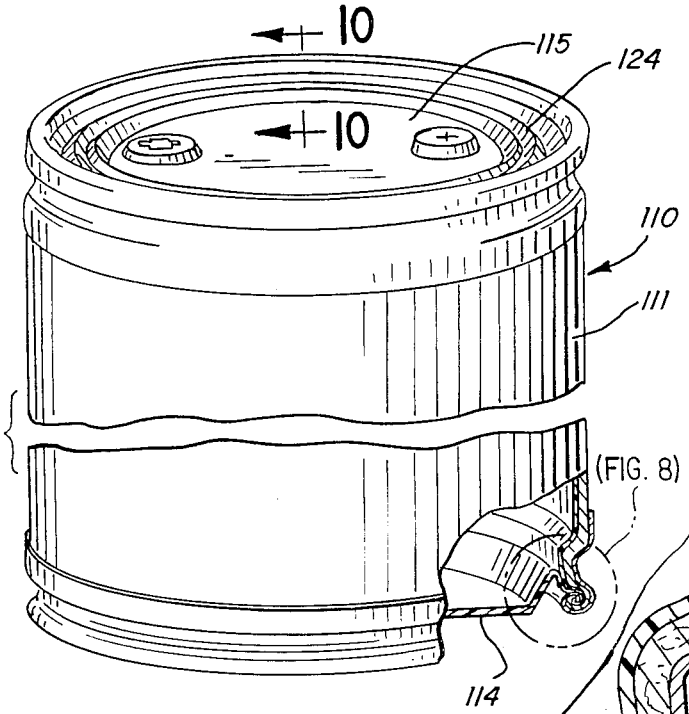
FIG. 7
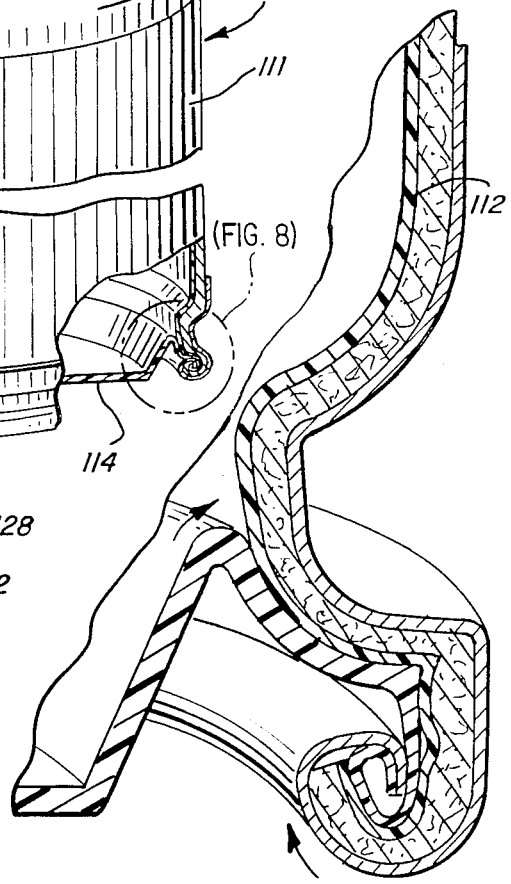
FIG. 6
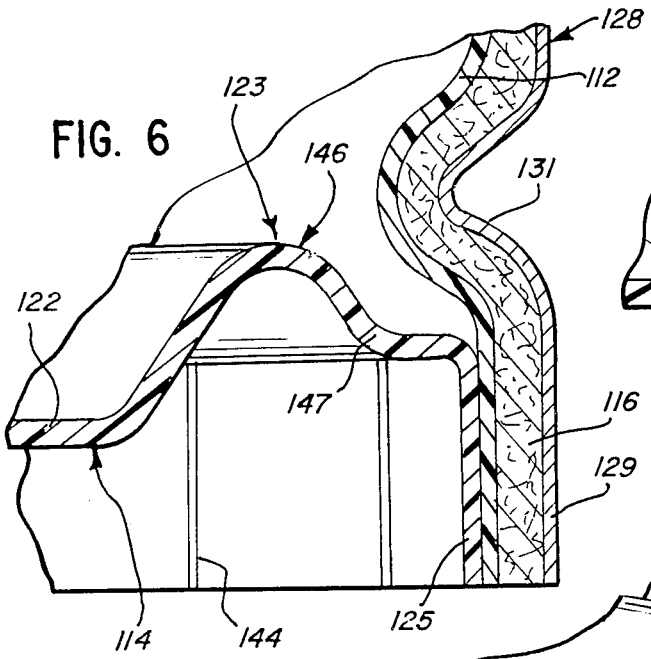
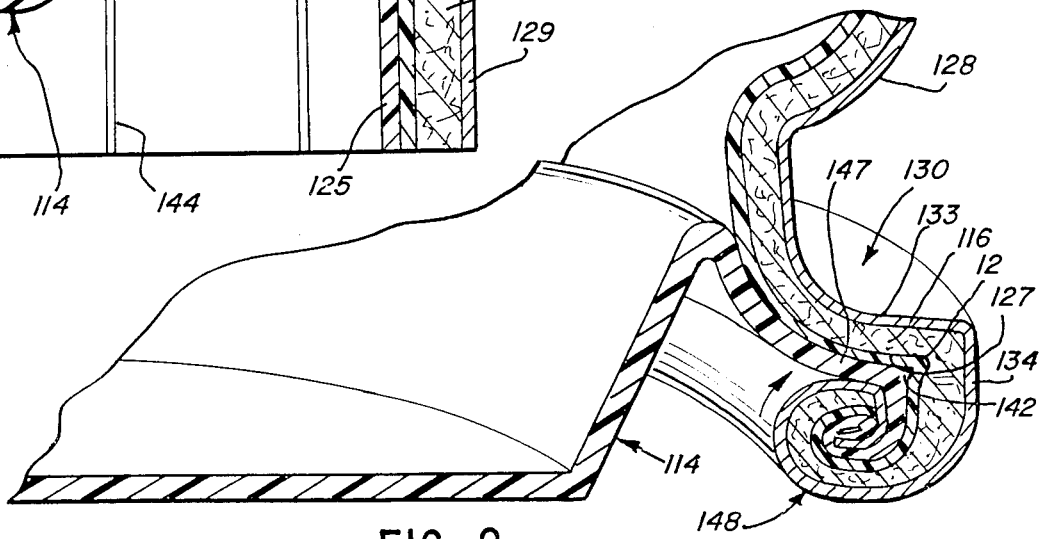
FIG. 8

FIG. 9
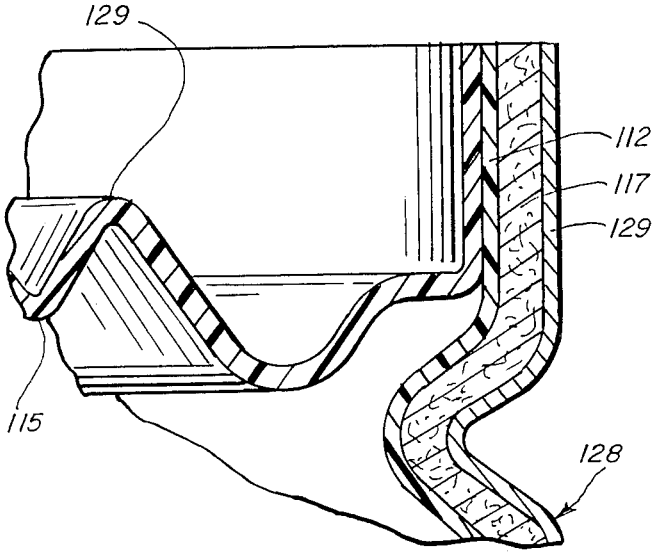
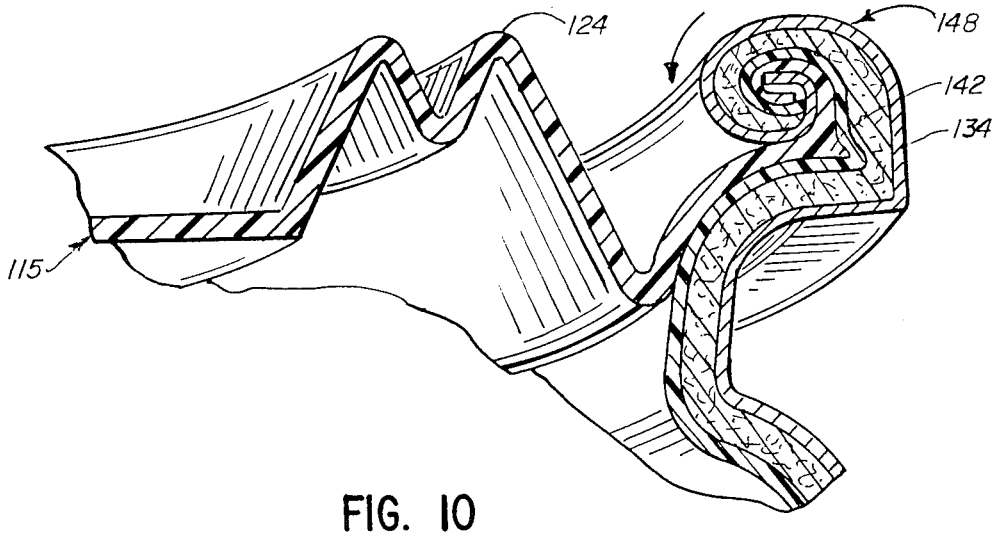
FIG. 10

SEALING CLOSURE FOR LINED DRUMS

TECHNICAL FIELD

This invention relates to containers and in particular to drums formed of liquid-permeable material, such as fiberboard.

BACKGROUND ART

In one conventional form of shipping container, a fiberboard drum is provided with a metal clamping ring at each end and fiberboard closure elements are secured across the open ends of the tubular drum by the clamping ring for effective retention of material within the drum, such as during storage and shipment.

When it is desired to ship liquids in such fiberboard drums, a problem arises in that the fiberboard material is liquid-permeable. Thus, it has been conventional to provide the liquid in a plastic bag within the fiberboard drum. Such an arrangement has not proven completely satisfactory, as the fiberboard bag of liquid does not normally fully fill the drum and movement thereof in shipment may cause rupture of the bag. Further, it is desirable at times to pour the liquid from the storage container without removing the bag therefrom and such liquid dispensing has proven difficult with the known means.

DISCLOSURE OF INVENTION

The present invention comprehends an improved container adapted to hold liquids within the conventional tubular fiberboard drum, or drum formed of similar liquid-permeable materials.

The invention comprehends the provision of an improved closure means in association with the opposite ends of the tubular fiberboard drum cooperating with a metal clamp ring so as to effectively seal the closure member to a tubular liner on the inner surface of the fiberboard drum.

In one illustrated embodiment, the container comprises a closure formed of a synthetic resin having a central wall portion, a peripheral portion having a thickness greater than that of the central wall portion, and a turned distal flange provided with circumferential spaced slots, an end portion of the liner being disposed between the closure flange and the end portion of the drum, and a rigid clamp ring embracing the closure flange, the liner end portion, and the drum end portion, the clamp ring having an annular recess defined at an axially outer end thereof by an annular radially extending clamping wall portion, an annular retaining wall portion extending axially outwardly from the clamping wall portion, an annular turned end portion extending arcuately axially outwardly and radially inwardly from an outer end of the retaining wall portion, and an annular returned portion extending arcuately axially inwardly and radially outwardly from an axially inner end of the turned end portion, the returned portion of the clamp ring cooperating with the clamping wall portion to sealingly clamp the liner to the peripheral portion of the closure, and the retaining wall portion and turned end portion of the clamp ring cooperating with the peripheral portion and distal flange of the closure to sealingly clamp the liner thereto.

In a second illustrated embodiment, the closure includes a central wall portion, an annular outer wall portion defining an annular raised boss having an arcuate cross section and including a peripheral portion, and a downturned distal flange extending from said peripheral portion and being provided with cicumferential spaced slots.

Such means may be provided at each of the opposite ends of the drum within the broad scope of the invention.

The invention is advantageously adapted for use with drums formed of fiberboard.

In the illustrated embodiments, the liner is formed of a synthetic resin, such as polyethylene.

The clamp ring is preferably formed of a deformable rigid material, such as metal.

The return portion of the clamp ring includes an underturned distal end extending away from the peripheral portion of the closure.

The flange of the closures includes a radially outwardly projecting annular bulge adjacent the peripheral portion, the end of the drum and a portion of the liner being clamped between the bulge and the retaining wall portion of the clamp ring.

The drum end portion defines a distal end captured between the turned end portion and the returned portion of the clamp ring.

Each of the drum end portion and the liner defines a distal end captured between the turned end and the returned portions of the clamp ring.

The closures may include an annular corrugated portion between the central wall portion and the peripheral portion.

The liner may be adhered to the inner surface of the drum.

The returned portion of the clamp ring includes an underturned distal end extending away from the peripheral portion of the closures and having an annular tip engaging the closure flange to clamp the liner between the closure flange and drum end portion inwardly of the turned end portion of the clamp ring.

The closures may be provided with a liquid-passing opening and means for selectively sealingly closing the opening.

The container may be vented by the provision of a vent opening in one of the closures and means for selectively sealingly closing the vent opening when venting is not desired.

The outermost portion of the corrugated portion of the closure and the outermost portion of the annular turned portion of the clamp ring are coplanar in the illustrated embodiments thereof, whereby a plurality of such containers may be readily stacked one upon the other.

The container structures of the present invention are extremely simple and economical, while yet providing an improved liquid-holding fiberboard container means, as discussed above.

BRIEF DESCRIPTION OF THE DRAWINGS

Other features and advantages of the invention will be apparent from the following description taken in connection with the accompanying drawing wherein:

FIG. 1 is a fragmentary side elevation with portions broken away to facilitate illustration of the invention;

FIG. 2 is a fragmentary enlarged vertical section illustrating the sealed connection of the closure with the liner at the end of the drum;

FIG. 3 is a fragmentary perspective view illustrating the pouring of liquid from the container;

FIG. 4 is a fragmentary exploded view illustrating the arrangement of the closure, liner, fiberboard drum end, and clamp ring prior to the forming thereof into the sealed connection of FIG. 2;

FIG. 5 is a fragmentary side elevation with portions broken away of a preferred form of the invention;

FIG. 6 is a fragmentary enlarged vertical section illustrating the arrangement of the closure, liner, drum end and clamp ring prior to the formation of the sealed connection therebetween;

FIG. 7 is a fragmentary enlarged vertical section illustrating the arrangement of the elements at an intermediate step in the forming of the sealed connection therebetween;

FIG. 8 is fragmentary enlarged vertical section illustrating the sealed connection of the closure with the liner at the end of the drum;

FIG. 9 is a fragmentary enlarged vertical section illustrating the arrangement of the closure, liner, drum end, and clamp ring prior to forming a sealed connection therebetween at an upper end of the drum; and FIG. 10 is a fragmentary enlarged vertical section illustrating the sealed connection of the closure with the liner at the upper end of the drum.

BEST MODE FOR CARRYING OUT THE INVENTION

In the illustrative embodiment of the invention as disclosed in the drawing, a container generally designated 10 includes a tubular fiberboard drum 11 having a liner 12 on the inner surface 13 thereof. The liner is formed of a suitable liquid-impermeable synthetic resin, such as polyethylene and may be of food quality material where it is desired to retain potable liquids in the container.

Means are provided for sealingly closing the opposite end portions of the drum, and in the illustrated embodiment of FIGS. 1–4, similar closure means generally designated 14 and 15 are provided at the opposite end portions 16 and 17 of the drum, respectively.

As shown in FIGS. 1 and 3, the upper closure 15 may be provided with a liquid-passing opening 18 and a vent opening 19 selectively sealingly closed by closure elements 20 and 21, respectively.

The means for sealing the closure element to the end of the fiberboard drum is similar with respect to both closure elements 14 and 15, and the following description of the sealed connection, as illustrated in FIG. 2, will be directed solely to the lower sealed connection, it being understood that the description applies equally to the connection of the upper closer to the upper end of the drum.

The closure is formed of a synthetic resin, such as polyethylene, and includes a central wall portion 22. The annular peripheral wall portion 23 of the closure has a thickness greater than the thickness of the central wall portion. An annular corrugated portion 24 is disposed between the central wall portion 22 and peripheral wall portion 23.

A turned distal flange 25 is provided at the outer edge portion 26 of the closure peripheral portion 23.

An annular end portion 27 of liner 12 is disposed radially outwardly of flange 25 and edge portion 26. End portion 16 of the drum 11 is disposed radially outwardly of the liner end portion 27.

A clamp ring generally designated 28 is disposed radially outwardly of the drum end portion 16 and, prior to the formation of the sealed connection of the closure 14 to the drum, includes an end portion 29 projecting beyond the end portion 16 of the drum. In the illustrated embodiment, the clamp ring is formed of metal.

In effecting the seal of the closure to the drum, the clamp ring is reformed under substantial constrictive pressure forces by suitable means (not shown) to define a sealed connection generally designated 30, as shown in FIG. 2, between the closure peripheral portion 23 and drum end portion 16.

More specifically, the originally cylindrical ring 28 is reformed to define a radially outwardly opening annular recess 31 in a concurrently complementary formed recess 32 in the fiberboard end 16. The lower end of the clamp ring recess 31 is defined by a radially outwardly extending clamping wall portion 33.

A retaining wall portion 34 extends axially from the radially outer edge of the clamping wall portion.

An annular turned end portion 36 extends arcuately axially outwardly and radially inwardly from an outer end 37 of the retaining wall portion 34.

An annular returned portion 38 extends arcuately axially inwardly and radially outwardly from an axially inner end 39 of the turned end portion 36.

The returned portion 38 cooperates with the clamping wall portion 33 to sealingly clamp the liner end portion 27 to the peripheral portion 23 of closure 15.

The retaining wall portion 34 and turned end portion 36 of the clamp ring cooperate with peripheral portion 23 and distal flange 25 of closure 15 to sealingly clamp the liner thereto.

Returned portion 38 of the clamp ring includes an underturned distal end 40 extending radially and axially outwardly away from the peripheral portion 23 of closure 15. As seen in FIG. 2, the annular tip 41 of distal end 40 engages the closure flange 25 to clamp the liner between the closure flange and the drum end portion 16 inwardly of the turned end portion 36 of clamp ring 28.

As further illustrated in FIG. 2, in the made-up sealed arrangement of the drum and closure, flange 25 includes a radially outwardly projecting annular bulge 42 adjacent peripheral portion 23. The drum end and a portion of the liner end 27 is clamped between bulge 42 and the retaining wall portion 37 of the clamp ring.

As further illustrated in FIG. 2, drum end portion 16 defines a distal end 43 captured between the turned end portion 36 adjacent the end 39 thereof and the returned portion 38, with the distal end of the liner and flange being also captured therebetween, as seen in FIG. 2.

Liner 12 may be bonded to the inner surface 13 by any suitable means, which may include heat sealing, adhesive bonding, etc., as appropriate for the selected liner material.

In the embodiment of FIGS. 1–4, the lower edge of the corrugations 24 and turned portion 36 are coplanar so that a plurality of such containers may be readily stacked one upon the other.

In the embodiment of FIGS. 1–4, the closure flange 25 is provided with circumferentially spaced slots 44 extending the height of the flange for facilitated constriction thereof from the cylindrical configuration of FIG. 4 to the inturned configuration of FIG. 2 in the makeup of the sealed connection.

In the embodiment of FIGS. 1–4, the closure central wall portion has a thickness of approximately 0.09", the corrugated portion has a thickness of approximately 0.09" and a maximum height of approximately 7/16", and the peripheral portion 23 has a thickness of at least approximately 0.250". The peripheral portion has a radial extent of approximately 1.75".

The closure is provided with a relatively large radially inwardly facing radius 45 at the juncture between flange 25 and the edge portion 26 of the peripheral portion 23. The flange, in the illustrated embodiment, has a height of approximately $\frac{5}{8}$" from the edge portion 26 and flares downwardly and ouuotwardly at an angle of approximately 15° to the axis thereof. The flange tapers from a thickness of approximately 0.060" at the distal end to a thickness of approximately 0.075" at the juncture with the edge portion 26. The periphery of edge portion 26 is substantially cylindrical.

The slots 44 in flange 25 have a width of approximately $\frac{1}{8}$" and are spaced approximately 2" apart circumferentially of the flange.

The closure may be provided without the corrugations 24 within the broad scope of the invention. In the illustrated embodiment, the corrugated portion 24 has a thickness similar to that of the central portion 22.

The forming of the sealed connection 30 is readily effected by suitable forming tools so as to provide a strong clamping force between the clamp ring portions 33 and 38 to effect a positive seal of the closure peripheral portion 23 to the liner portion 27. As further shown in FIG. 2, the portion of the liner extending downwardly from the sealed portion 27 may also provide a sealing effect relative to the outer surface of the peripheral portion 23 and the flange 25.

A preferred form of means for sealingly closing the drum at the end portions thereof embodying the invention is illustrated in FIGS. 5–10. As shown therein, the container 110 includes a drum 111, a liquid impermeable liner 112, and a pair of closures 114 and 115 for closing the lower and upper ends of the drum, respectively. As shown in FIG. 5, the upper closure 115 may be provided with an annular corrugated portion 124 similar to corrugated portion 24 of closure 14.

Closures 114 and 115 differ from closures 14 and 15 in the construction of the peripheral portion 123 thereof. Thus, as shown in FIG. 6, peripheral portion 123 has a wall thickness substantially equal to the wall thickness of the central wall portion 122 of the closure.

Peripheral portion 123 includes an annular raised boss 146 having an arcuate cross section, as seen in FIG. 6. The boss includes a peripheral portion 147. The distal portion 125 of the closure defines a right circularly cylindrical flange 125, which is connected to the midportion 122 by the annular boss 146.

As in closures 14 and 15, the flange is provided with a plurality of circumferentially spaced slots 144 for facilitated reforming thereof in forming the sealed connection of the closure to the drum end.

As illustrated in FIGS. 6–8, the sealed connection of the closure to the drum end is effected by a reforming of a right circularly cylindrical clamp ring by successive reforming steps. As shown in FIG. 6, an annular recess 131 is firstly formed in the clamp ring to correspondingly form a recess in the drum end 116, and the liner 112 adhered to the inner surface of the drum end.

The constriction of the clamp ring and drum end at recess 131 is continued while the distal end of the flange 125, liner 112, drum end 116, and clamp ring 129 is underturned, as seen in FIG. 7, and then returned, as seen in FIG. 8.

In the final sealed connection 130, a radially extending clamping wall portion 133 of the clamp ring 12 clamps the drum end 116 and liner portion 127 to the boss portion 147 of the peripheral portion of the closure, as shown in FIG. 8.

Thus, as seen in FIG. 8, the turned and returned distal end portions of the clamp ring, drum liner, and closure elements serves as a rigid ring against which the end of the drum is sealed to the closure by the clamping of the liner end therebetween as a result of the reformation of the clamp ring portion 133 toward the turned and returned end portion means 148 of the assembly.

It has been found that the arrangement of FIG. 8 provides an improved sealed connection of the closure to the drum end by positively sealingly clamping the liner therebetween. The forming of the sealed connection is extremely simple as a result of the simple constriction of the recess portion 131 during concurrent turning and returning of the distal end portions of the elements, as illustrated in FIGS. 6–8.

As illustrated in FIGS. 9 and 10, the turned and returned end portion 148 of the closure may be provided similarly on the upper closure 115, which, as shown in FIGS. 9 and 10, may include the annularly corrugated portion 124 described above. Thus, the upper end of the drum may be similarly sealingly closed by means of the closure 115 and a similar forming and reforming of the upper distal ends of the closure flange, liner, drum end, and clamp ring.

Except for the provision of the corrugations 124, the arrangement of the closure 115 and its sealed connection to the upper end of the drum 110 is similar to the connection of the lower closure element 114 to the lower end of the drum. As shown in FIG. 9, the thickness of the closure wall at corrugations 124 is similar to the thickness in the other portions thereof.

As shown in FIGS. 8 and 10, the reformation of the flange defines an outwardly projecting annular bulge 142 which provides a further positive sealing of the liner between the flange and the formed portion of the drum end adjacent the clamp ring portion 133 and radially inwardly of a retaining wall portion 134 thereof.

Sealed connection 148 is similar to sealed connection 30 of the embodiment of FIGS. 1–4 in all other respects. Portions of the structure of the closure structure of the embodiment of FIGS. 5–10 which are similar to corresponding elements of the closure structure of the embodiment of FIGS. 1–4 are identified by similar reference numerals but 100 higher. Description thereof with respect to the embodiment of FIGS. 1–4 is therefore equally applicable to the corresponding structure in the embodiment of FIGS. 5–10.

The sealed connections 30 and 148 have been found to be extremely strong and durable, maintaining the sealed connections between the closures and the liners of such drums notwithstanding substantial forces being applied thereto, such as by dropping the filled container from a substantial height. The reversed C-shaped arrangement of the turned and returned portions of the clamp ring provides a resiliency relative to the clamping portions thereof accommodating such forces which would otherwise tend to disrupt the sealed connections.

The formation of the sealed connections 30 and 148 are extremely simple, while yet providing the highly desirable provision of a liquid-impermeable fiberboard drum utilizing, in combination with the synthetic resin closures, a readily formable metal clamp ring.

As indicated above, not only are the containers 10 and 110 adapted for holding liquid, but also by virtue of the provision of the selectively closed openings in the top closures, may be utilized for pouring the liquid directly therefrom when desired.

The foregoing disclosure of specific embodiments is illustrative of the broad inventive concepts comprehended by the invention.

I claim:

1. In a container for holding liquids, said container including a tubular drum formed of liquid-permeable material defining an end portion and an inner surface, and a liquid-impermeable liner facially juxtaposed to said drum inner surface, means for sealingly closing said drum at said end portion comprising:

a closure formed of a synthetic resin having a central wall portion, a peripheral portion having a thickness greater than that of said central wall portion, and a turned distal flange provided with circumferential spaced slots, an end portion of said liner being disposed between said closure flange and said end portion of said drum; and a rigid clamp ring embracing said closure flange, said liner end portion, and said drum end portion, said clamp ring having an annular recess defined at an axially outer end thereof by an annular radially extending clamping wall portion, an annular retaining wall portion extending axially outwardly from said clamping wall portion, an annular turned end portion extending arcuately axially outwardly and radially inwardly from an outer end of said retaining wall portion, and an annular returned portion extending arcuately axially inwardly and radially outwardly from an axially inner end of said turned end portion, said returned portion of the clamp ring cooperating with said clamping wall portion to sealingly clamp said liner to said peripheral portion of the closure, and said retaining wall portion and turned end portion of the clamp ring cooperating with said peripheral portion and distal flange of the closure to sealingly clamp said liner thereto.

2. In a container for holding liquids, said container including a tubular drum formed of liquid-permeable material defining an end portion and an inner surface, and a liquid-impermeable liner facially juxtaposed to said drum inner surface, means for sealingly closing said drum at said end portion comprising:

a closure formed of a synthetic resin having a central wall portion, an annular outer wall portion defining an annular raised boss having an arcuate cross section and including a peripheral portion, and a downturned distal flange extending from said peripheral portion and being provided with circumferential spaced slots, an end portion of said liner being disposed between said closure flange and said end portion of said drum; and a rigid clamp ring embracing said closure flange, said liner end portion, and said drum end portion, said clamp ring having an annular recess defined at an axially outer end thereof by an annular radially extending clamping wall portion, an annular retaining wall portion extending axially outwardly from said clamping wall portion, an annular turned end portion extending arcuately axially outwardly and radially inwardly from an outer end of said retaining wall portion, and an annular returned portion extending arcuately axially inwardly and radially outwardly from an axially inner end of said turned end portion, said returned portion of the clamp ring cooperating with said clamping wall portion to sealingly clamp said liner to said peripheral portion of the closure, and said retaining wall portion and turned end portion of the clamp ring cooperating with said peripheral portion and distal flange of the closure to sealingly clamp said liner thereto.

3. The container of claim 1 or 2 wherein means for sealingly closing the drum are provided at the opposite end portions of said tubular drum.

4. The container of claim 1 or 2 wherein said drum is formed of fiberboard.

5. The container of claim 1 or 2 wherein said liquid-impermeable liner is formed of a synthetic resin.

6. The container of claim 1 or 2 wherein said closure is formed of polyethylene

7. The container of claim 1 or 2 wherein said clamp ring is formed of metal.

8. The container of claim 1 or 2 wherein said returned portion of the clamp ring includes an underturned distal end extending away from said peripheral portion of the closure.

9. The container of claim 1 or 2 wherein said flange of the closure includes a radially outwardly projecting annular bulge adjacent said peripheral portion, said end of the drum and a portion of said liner being clamped between said bulge and said retaining wall portion of the clamp ring.

10. The container of claim 1 or 2 wherein said drum end portion defines a distal end captured between said turned end portion and said returned portion of said clamp ring.

11. The container of claim 1 or 2 wherein said drum end portion and said liner define distal ends captured between said turned end portion and said returned portion of said clamp ring.

12. The container of claim 1 or 2 wherein said closure includes an annular corrugated portion between said central wall portion and said peripheral portion.

13. The container of claim 1 or 2 wherein said liner is adhered to the inner surface of the drum.

14. The container of claim 1 or 2 wherein said returned portion of the clamp ring includes an underturned distal end extending away from said peripheral portion of the closure and having an annular tip engaging said closure flange to clamp said liner between said closure flange and drum end portion inwardly of said turned end portion of the clamp ring.

15. In a container for holding liquids, said container including a tubular drum formed of liquid-permeable material defining an opposite end portion and an inner surface, and a liquid-impermeable liner facially juxtaposed to said drum inner surface, means for sealingly closing said drum at each said end portion, each said closing means comprising:

a closure formed of a synthetic resin having a central wall portion, a peripheral portion, and a turned distal flange provided with circumferential spaced slots, an end portion of said liner being disposed between said closure flange and said end portion of said drum; and a rigid clamp ring embracing said closure flange, said liner end portion, and said drum end portion, said clamp ring having an annular recess defined at an axially outer end thereof by an annular radially extending clamping wall portion, an annular retaining wall portion extending axially outwardly from said clamping wall portion, an annular turned end portion extending arcuately axially outwardly and radially inwardly from an outer end of said retaining wall portion, and an annular returned portion extending arcuately axially inwardly and radially outwardly from an axially inner end of said turned end portion, said returned portion of the clamp ring cooperating with said clamping wall portion to sealingly clamp said liner to said peripheral portion of the closure, and said retaining wall portion and turned end portion of the clamp ring cooperating with said peripheral portion and distal flange of the closure to sealingly clamp said liner thereto.

16. The container of claim 15 wherein the central wall portion of at least one of said closure means is provided with a liquid-passing opening, and means for selectively sealingly closing said opening.

17. The container of claim 15 wherein the central wall portion of at least one of said closure means is provided with a liquid-passing opening, means for selectively sealingly closing said opening, a vent opening, and means for selectively sealingly closing said vent opening.

18. The container of claim 15 wherein each said closure means includes an annular corrugated portion between said central wall portion and said peripheral portion, said corrugated portion of the closure and said annular turned portion of the clamp ring defining coplanar outermost portions thereof.

19. The container of claim 2 wherein each of said closure central wall portion, outer wall portion, and distal flange has a substantially similar thickness.

* * * * *